United States Patent [19]

Southerlin et al.

[11] 4,341,063

[45] Jul. 27, 1982

[54] AIR TEXTURED YARNS

[75] Inventors: William F. Southerlin, Travelers Rest; Paul W. Eschenbach, Moore, both of S.C.

[73] Assignee: Milliken Research Corporation, Spartanburg, S.C.

[21] Appl. No.: 181,636

[22] Filed: Aug. 26, 1980

[51] Int. Cl.[3] ..... D02B 1/20; D02G 3/38

[52] U.S. Cl. ..... 57/6; 57/245; 57/289; 57/287; 57/288; 57/310; 57/908

[58] Field of Search ..... 57/6, 9, 12, 14, 282, 57/284, 287, 289, 290, 310, 350, 351, 908, 288

[56] References Cited

U.S. PATENT DOCUMENTS

| | | | |
|---|---|---|---|
| 3,199,281 | 8/1965 | Maerov et al. | 57/908 X |
| 3,481,136 | 12/1969 | Timmons et al. | 57/310 X |
| 4,019,312 | 4/1977 | Warrick | 57/908 X |
| 4,219,997 | 9/1980 | Hatcher | 57/908 X |
| 4,292,799 | 10/1981 | Otaki et al. | 57/245 X |
| 4,307,565 | 12/1981 | Saski et al. | 57/288 X |

*Primary Examiner*—Donald Watkins

*Attorney, Agent, or Firm*—Earle R. Marden; H. William Petry

[57] ABSTRACT

Method to provide a novel air textured yarn by combining a cold drawn core yarn and a false twisted effect yarn in a fluid tangling zone.

1 Claim, 1 Drawing Figure

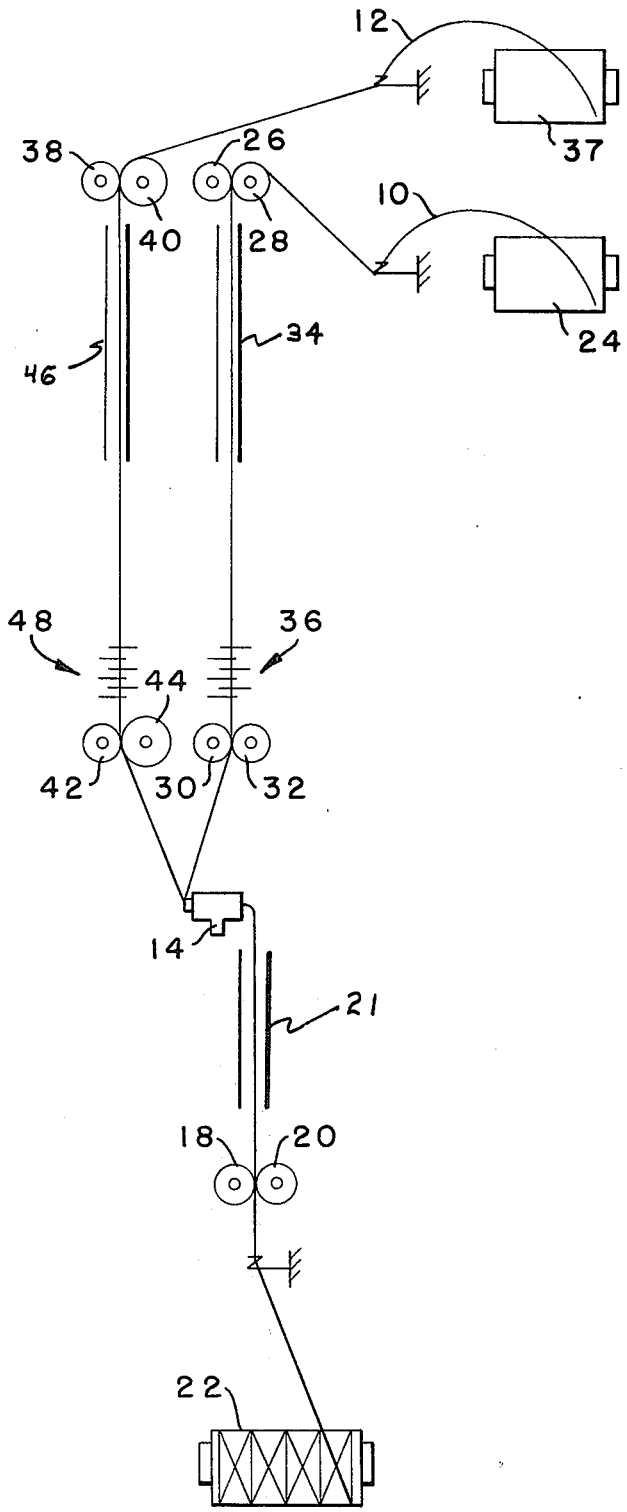
12
37
38
26
10
40
28
24
34
46
48
36
44
42
30
32
14
21
18
20
22

AIR TEXTURED YARNS

This invention relates generally to yarns produced by combining a false twisted yarn and a cold drawn yarn in an air jet to supply a continuous, multi-filament textured yarn.

It is therefore an object of the invention to provide a method to produce a novel, multi-filament yarn.

Other objects and advantages of the invention will become readily apparent as the specification proceeds to describe the invention with reference to the accompanying drawing, in which:

FIG. 1 is a schematic representation of the apparatus and method to produce the novel yarn.

Looking now to the drawing, there is shown one embodiment of an apparatus for producing the novel yarn composed of a core yarn and an effect yarn. In the preferred form of the invention, both the core yarn 10 and the effect yarn 12 are continuous, multi-filament, partially oriented polyester yarns but, obviously, other partially oriented or fully oriented synthetic, continuous, multi-filament yarns such as nylon, Dacron, etc. can be employed, if desired.

The core and effect yarns 10 and 12 are combined in the air jet 14 to produce the textured yarn 16 which is delivered by the take-up nip rolls 18 and 20 through the secondary heater 21 to the take-up roll 22. The core yarn 10 is delivered from the package 24 to the false twist zone by the first delivery rolls 26 and 28. The second delivery rolls 30 and 32 draw the core yarn 10 as it passes through the primary heater 34 and the false twist device 36, illustrated as friction discs, and supplies it to the air jet 14.

The effect yarn 12 is delivered from the package 37 to the false twist zone by the first delivery rolls 38 and 40 and is drawn by the second delivery rolls 42 and 44 as it passes through the primary heater 46 and false twist device 48, illustrated as friction discs. From the delivery rolls 42 and 44, the effect yarn 12 is delivered to the air jet 14.

The speeds of the delivery rolls are pre-selected to provide a desired result in the yarn produced. In the preferred form of the invention, the speed of the rolls 26, 28, 38 and 40 is so selected that the speed of the effect yarn 12 being delivered thereby is greater than the speed of the core yarn 10. The speeds of the delivery rolls 30, 32, 42 and 44 are so selected that the delivery speed of the effect yarn 12 is greater than the speed of the core yarn 10. In the preferred form of the invention, since partially oriented yarn is being run, the speeds of rolls 30, 32, 42 and 44 are so selected to draw the effect and core yarns. The speed of the delivery rolls 18 and 20 is so selected that the yarn 16 delivered therefrom is at a speed lower than the speed of either the core yarn 10 or the effect yarn 12, respectively, from the rolls 30 and 32 or 42 and 44.

In the preferred operation of the apparatus in the drawing, the primary heater 46 for the effect yarn 12 is deactivated and the false twist device 48 eliminated to cold draw the partially oriented yard 12 between the rolls 38 and 42 and the rolls 42 and 44 thereby providing a hot drawn, false twisted yarn 10 and a cold drawn yarn 12 to the air jet 14 to be air textured and combined therein. It is within the scope of the invention to reverse the above action and provide a cold drawn effect yarn 10 and a false twisted, hot drawn core yarn 12.

The air jet 14 is a commercially available type and does not per se form a part of the invention other than that it accomplishes the desired result of combining and texturing the yarn.

The following is an example of the production of a yarn in the manner hereinbefore described.

EXAMPLE

The core and effect yarns are both 150 denier, 68 filament, 56T, partially oriented polyester yarn. The resultant combined yarn is 350 denier polyester yarn.

The combined yarn is formed under the following parameters:

Effect yarn velocity from first delivery rolls—235 meters/minute

Core yarn velocity from first delivery rolls—196 meters/minute

Primary heater 34 temperature—207° C.

Effect yarn velocity from second delivery rolls—388 meters/minute

Core yarn velocity from second delivery rolls—323 meters/minute

Primary heater 46 off

Combined yarn velocity to take-up rolls—280 meters/-minute

Combined yarn take-up velocity—307 meters/minute

It is obvious that an air textured yarn has been provided by efficiently combining a cold drawn core yarn and a false twisted effect yarn in an apparatus which employs air under pressure to commingle and texture the filaments of the core and effect yarns.

Although the preferred embodiment of the invention has been described specifically, it is contemplated that many changes may be made without departing from the scope or spirit of the invention, and we desire to be limited only by the claims.

We claim:

1. A method of making an air textured yarn having a core yarn and an effect yarn comprising the steps of: supplying a first partially oriented polyester yarn at a first feed rate, supplying a second partially oriented polyester yarn at a lower second feed rate, heating, false twisting, and drawing the first polyester yarn while cold drawing the second yarn, supplying the first and second yarns into an air jet, supplying gaseous fluid into the air jet to commingle and texture the first and second yarns and withdrawing the commingled and air textured yarn from the air jet at a third feed rate.

* * * * *

UNITED STATES PATENT OFFICE

CERTIFICATE OF CORRECTION

Patent No. 4,341,063 Dated July 27, 1982

Inventor(s) William F. Southerlin et al.

It is certified that error appears in the above-identified patent and that said Letters Patent are hereby corrected as shown below:

Column 2, line 4, "yard" should be --yarn--.

Signed and Sealed this

Fifth Day of October 1982

[SEAL]

Attest:

GERALD J. MOSSINGHOFF

Attesting Officer

Commissioner of Patents and Trademarks